US006391190B1

(12) United States Patent
Spence et al.

(10) Patent No.: US 6,391,190 B1
(45) Date of Patent: May 21, 2002

(54) MECHANICAL DEAERATION OF BITUMINOUS FROTH

(75) Inventors: Jonathan R. Spence, Edmonton; Kevin McDowell, Fort McMurray; Mike P. Wagner; Sean Sanders, both of Edmonton, all of (CA)

(73) Assignees: AEC Oil Sands, L.P.; AEC Oil Sands Limited Partnership; Athabasco Oil Sands Investments Inc.; Nexen Inc.; Canadian Oil Sand Investments Inc.; Conoco Oilsands Partnership; Imperial Oil Resources, all of Calgary (CA); Mocal Energy Limited, Tokyo (JP); Murphy Oil Company Ltd.; Petro-Canada Oil and Gas, both of Calgary (CA)

( * ) Notice: Subject to any disclaimer, the term of this patent is extended or adjusted under 35 U.S.C. 154(b) by 0 days.

(21) Appl. No.: 09/262,061

(22) Filed: Mar. 4, 1999

(51) Int. Cl.[7] ..... C10G 1/04
(52) U.S. Cl. ..... 208/390; 208/390; 208/341
(58) Field of Search ..... 208/390, 391

(56) References Cited

U.S. PATENT DOCUMENTS 3,343,816 A 9/1967 Reed
3,356,348 A * 12/1967 Paul ..... 259/108
3,784,464 A 1/1974 Kaminsky
3,998,702 A * 12/1976 Opoku ..... 23/257
4,116,809 A * 9/1978 Kizior ..... 208/391
4,354,852 A 10/1982 Kydd
4,369,047 A 1/1983 Arscott et al.
4,383,914 A 5/1983 Kizior
4,394,140 A 7/1983 Liljestrand
4,481,020 A 11/1984 Lee et al.
4,596,586 A 6/1986 Davies et al.
4,676,308 A 6/1987 Chow et al.
4,886,530 A 12/1989 Dussourd
4,900,433 A 2/1990 Dean et al.
4,981,175 A 1/1991 Powers
5,048,622 A 9/1991 Ide et al.
5,085,561 A 2/1992 Yano et al.
5,143,525 A 9/1992 Sotirianos
5,223,148 A 6/1993 Tipman et al.
5,236,577 A * 8/1993 Tipman et al. ..... 208/390
5,264,118 A * 11/1993 Cymerman et al. ..... 208/390
5,525,146 A 6/1996 Straub

* cited by examiner

*Primary Examiner*—Helane Myers
(74) *Attorney, Agent, or Firm*—Millen, White, Zelano & Branigan, P.C.

(57) ABSTRACT

Aerated bitumen froth obtained from oil sands must be deaerated so that it can be pumped through a pipeline. Mechanical shearing is effective to deaerate bitumen froth to an air content of below 10 volume percent. Mechanical deaeration of bitumen froth can be achieved either by passing the froth through a confining passageway and shearing the froth with an impeller while it is in the passageway or temporarily retaining the aerated froth in a tank and circulating it repeatedly through a pump.

12 Claims, 6 Drawing Sheets

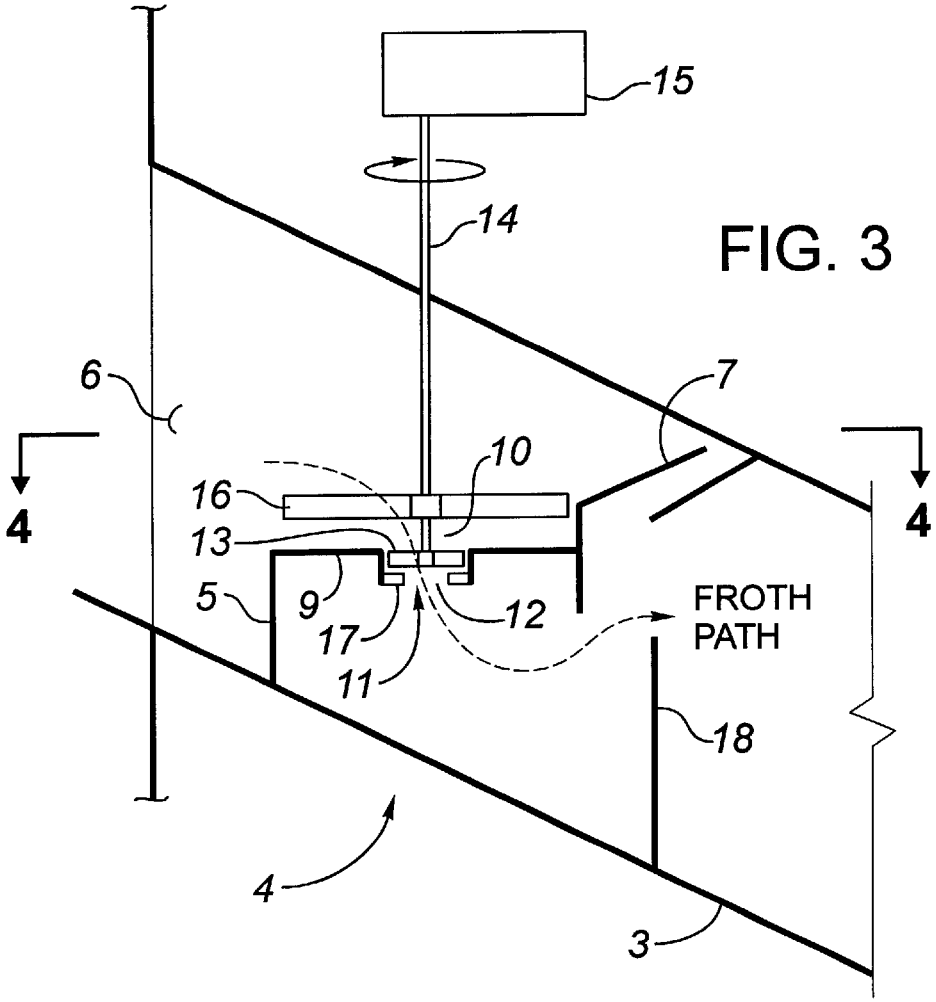
FIG. 3
FIG. 4
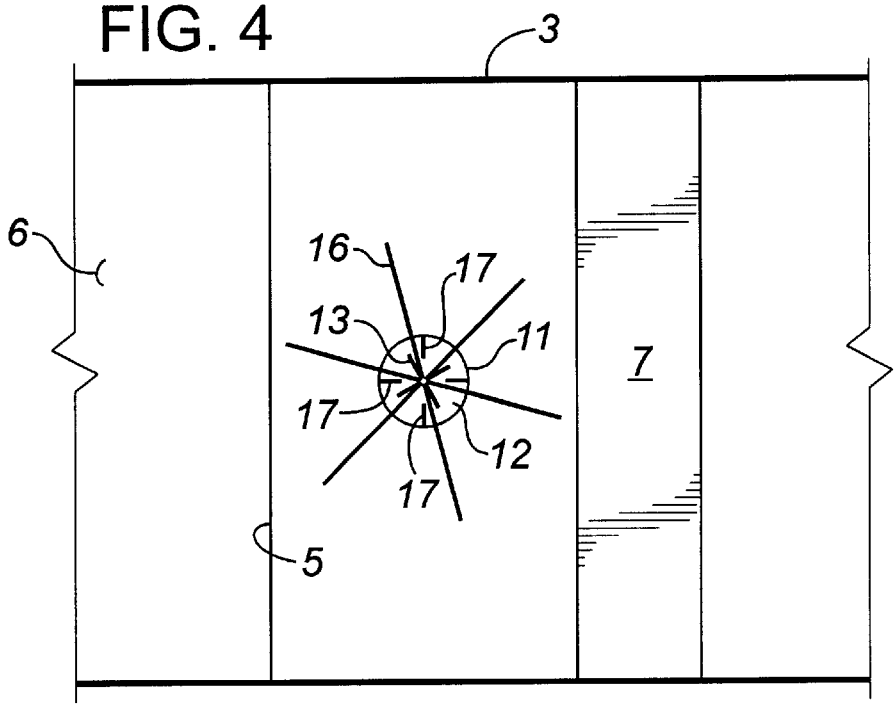

MECHANICAL DEAERATION OF BITUMINOUS FROTH

FIELD OF THE INVENTION

This invention relates to a method for mechanically deaerating aerated bitumen froth to reduce its air content to render it pumpable. More particularly it relates to mechanically shearing aerated bitumen froth by either passing the froth through a confining passageway and shearing the froth with an impeller while it is in the passageway or temporarily retaining the aerated froth in a tank and circulating it repeatedly through a pump.

BACKGROUND OF THE INVENTION

Oil sand, as known in the Fort McMurray region of Alberta, Canada, comprises water-wet sand grains having viscous bitumen flecks trapped between the grains. It lends itself to separating or dispersing the bitumen from the sand grains by slurrying the as-mined oil sand in water so that the bitumen flecks move into the aqueous phase.

For the past 25 years, the bitumen in McMurray sand has been commercially recovered from oil sand using a hot water process. In general terms, this process involves mixing surface-mined oil sand with heated water, steam and sodium hydroxide in a rotating tumbler to initially disperse the bitumen to form a slurry that has a temperature of about 80° C. The slurry is further diluted with heated water and then introduced into a primary separation vessel (PSV) where the more buoyant bitumen particles float to the surface to form a froth. This froth overflows the vessel wall and is received in a launder extending around the PSV's rim. The product is commonly called "primary froth" and typically comprises 66% bitumen, 9% solids and 25% water. It is usually at a temperature of about 75° C. The primary froth also contains approximately 30 vol. % air.

The primary froth typically is deaerated to about 13 vol. % air, at which point it is capable of being pumped by centrifugal pumps through a pipeline to the froth treatment plant. Deaeration is achieved by feeding the bitumen froth by gravity through a deaeration tower having vertically spaced sheds. The froth forms thin layers on the sheds and is countercurrently contacted with steam, to both heat and deaerate the froth. The deaerator circuit is similar to that described in U.S. Pat. No. 4,116,809, issued to Kizior on Sep. 26, 1978.

A recent development in the recovery of bitumen from oil sand involves a low energy extraction process (LEE process). The LEE process is not in the public domain but is in the process of being patented. The LEE process can be summarized as follows:

- locating a mine remote from the upgrading refinery;
- mixing the oil sand with heated water at the mine site to produce a
- pumpable, dense, low temperature slurry having a density in the range
- 1.4 to 1.65 g/cc and temperature in the range 20 to 35° C.;
- pumping the slurry through a pipeline to an extraction site, the pipeline
- being of sufficient length so that the slurry is conditioned for flotation;
- aerating the slurry and diluting it with water as it moves through the pipeline; and
- delivering the aerated diluted slurry into a primary separation vessel (PSV) and producing bitumen froth ("primary froth"). The buoyant bitumen froth floats to the surface of the PSV where it overflows the vessel's walls into a launder that recovers the overflowing bitumen froth. The LEE primary froth obtained from medium grade oil sand typically comprises 60% bitumen, 29% water and 11% solids and has an air content of approximately 50 vol. %. Depending on the oil sand and the experimental conditions, LEE froth air contents have been measured between 28 to 72 vol. %. As was the case with the bitumen froth obtained from the hot water process, the froth obtained using the LEE process must be deaerated to a reduced air content (preferably<10%) to minimize impact on pump performance when the froth is pumped by centrifugal pumps through the pipeline to the upgrading facility.

At the applicant's commercial operation, the current site for low energy extraction is 35 km away from the main processing plant and its utilities. Therefore, use of the conventional deaeration tower with steam to deaerate the bitumen froth would be very expensive for the following reasons:

- it would be expensive to move the steam from the main plant through a long pipeline to the extraction site in cold weather; and
- alternatively, it would be expensive to build a utility plant at the extraction site and heat and treat the water at that point. Steam production requires clean water and therefore the water must be chemically treated before it can be reused. In light of the above, an alternate process for deaerating low energy froth was pursued using mechanical break-up or shearing.

There are two concerns that need to be addressed when designing a mechanical shearing process for use with a unique feed stock such as bitumen froth. Firstly, there is a concern that if the mechanical shearing is too vigorous, the air bubbles will actually break up into even smaller air bubbles. It is known in the art that it is more difficult for smaller bubbles to move through the bitumen matrix and reach the surface where they can break out.

Second, there is a concern that mechanical shearing will cause the water and solids in the bitumen froth to emulsify. If emulsification occurs, it makes it more difficult for the downstream centrifuges to carry out their separation work, that is, to separate the solids and water from the bitumen.

Taking into account the above concerns, two alternative mechanical shearing processes have been developed which are specifically tailored to be used with low temperature (20 to 45° C.), viscous, solids-containing bitumen froth.

SUMMARY OF THE INVENTION

The present invention is based on the discovery that mechanical shearing is effective to deaerate bitumen froth sufficiently so that it is pumpable and thus can be propelled through a pipeline. The discovery is particularly useful because it has been shown to work with LEE bitumen froth, which typically has a temperature between 20 to 45° C. and therefore is quite viscous. It was not predictable that mechanical shearing would be effective to reduce the air content in such froth to less than 10 vol. %, preferably about 6 vol. %. The air content in deaerated froth has to be sufficiently low in order for the froth to be pumpable for pipeline purposes. We have demonstrated that two distinct ways of mechanically shearing the froth will reduce its air content to the desired level. More particularly:

- passing the froth through a confining passageway and shearing the froth with an impeller while it is in the passageway; or temporarily retaining the aerated froth in a tank and circulating it repeatedly through a pump;

will each serve to successfully deaerate the froth so that it is pumpable.

So, in one aspect the invention provides a method for deaerating bitumen froth produced by flotation in a primary separation vessel and recovered therefrom, comprising mechanically shearing the froth to reduce its air content sufficiently so that the deaerated froth can be pumped through a pipeline.

Having ascertained that mechanically shearing LEE bitumen froth will work to deaerate it as required, we have combined it with the LEE process to provide a novel method for recovering deaerated bitumen froth from oil sand containing bitumen comprising:

dry mining the oil sand;

mixing the as-mined oil sand with heated water to produce a slurry having a density in the range 1.4 to 1.65 g/cc and a temperature in the range 20 to 35° C.;

pumping the slurry through a pipeline for sufficient distance to condition the slurry;

adding flood water and air to the slurry, preferably as it moves through the pipeline, to produce a diluted, aerated slurry;

introducing the product slurry into a primary separation vessel and temporarily retaining it therein under quiescent conditions while simultaneously preferably injecting hot underwash water just below the forming froth to raise its temperature and venting excess air out of the PSV feedwell, to produce aerated bitumen froth; and recovering the froth and mechanically shearing it to deaerate it sufficiently so that the deaerated froth can be pumped through a pipeline.

BRIEF DESCRIPTION OF THE DRAWINGS

FIG. 3 is a schematic side view of the deaerating device identified by the circle in FIG. 2;

FIG. 4 is a top plan view of part of the device of FIG. 3;

DESCRIPTION OF THE PREFERRED EMBODIMENT

The theory behind using mechanical shearing as a means of releasing the air from bitumen is as follows. It is believed that forces of mechanical shearing cause the air bubbles to elongate which results in more air bubble surface area. Therefore, there is a greater opportunity for the air bubbles to contact one another and coalesce into larger air bubbles. It is known in the art that it is much easier for larger bubbles to reach the surface of the bitumen froth and break out. Also, the entrapped air bubbles have a greater potential for exposure to the air surface of the bitumen froth if the bitumen froth is constantly mixed. Once exposed to the air surface, the air bubbles can then be quickly released to the atmosphere.

Figure 1:
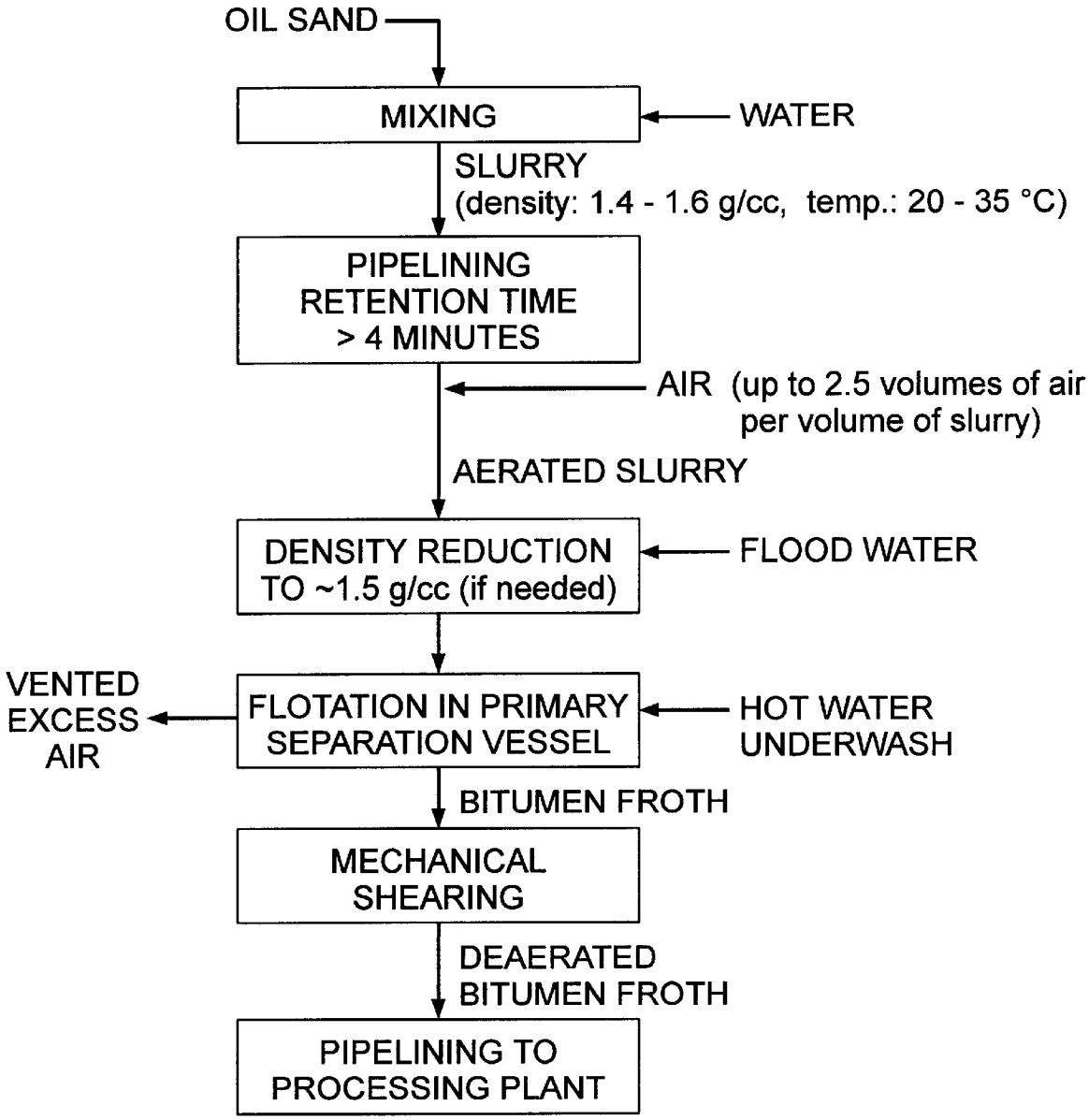
FIG. 1 is a block diagram setting forth the process in accordance with the invention.

Aerated oil sand slurry is prepared at low temperature as set out in FIG. 1 and described as follows. In the low energy extraction process (LEE process), the oil sand is dry mined and mixed at the mine site with water using means such as a cyclofeeder to produce a dense (between 1.4 and 1.65 g/cc) slurry having a low temperature (in the range of 20 to 35° C.). The dense slurry is then pumped through a pipeline having sufficient length so that the retention time is at least 4 minutes, to achieve conditioning of the slurry. Air is added to the slurry as it moves through the pipeline to produce aerated slurry. The resulting aerated, dense, low temperature slurry can be fed at high loading into a primary separation vessel (PSV). The slurry is continuously introduced into the PSV where the sand settles to the bottom and the bitumen froth floats to the top. The aerated bitumen froth is then deaerated so that the bitumen froth can be pipelined to the extraction site for further processing.

Figure 2:
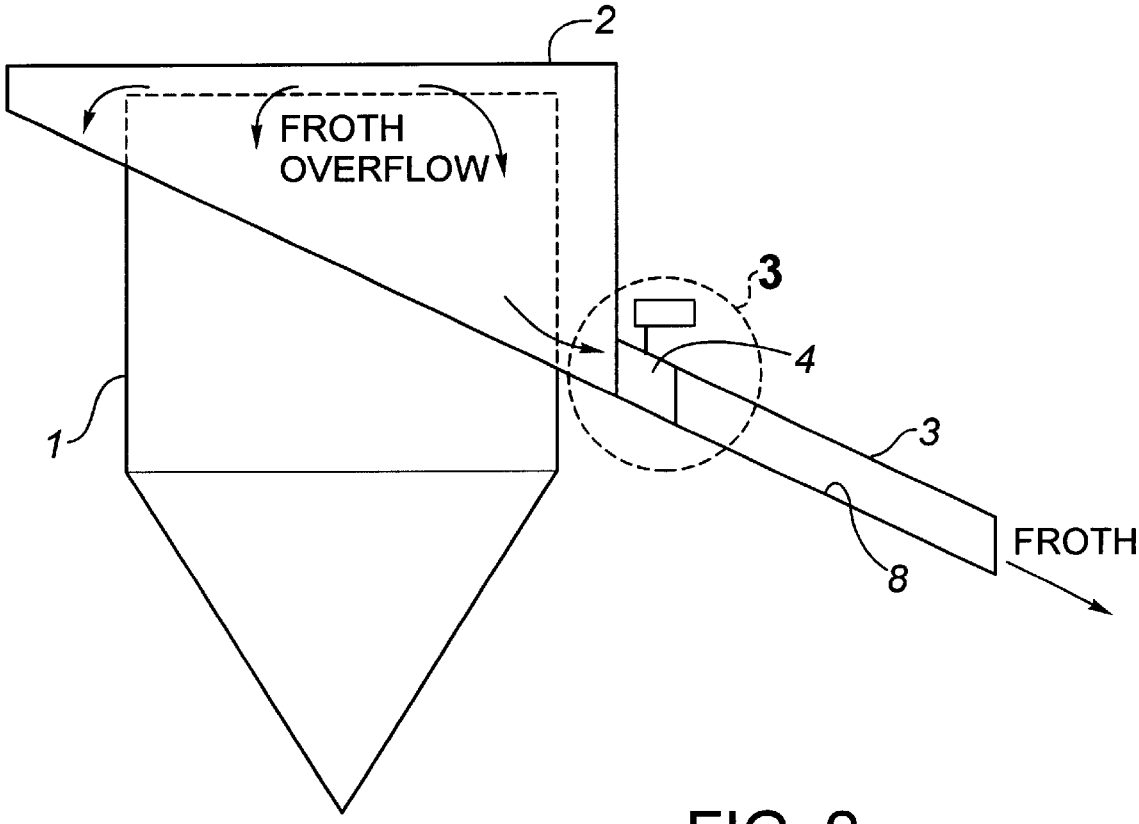
FIG. 2 is a schematic side view of the PSV that has been equipped with a deaerating device forming part of the launder.

As shown in FIGS. 2 and 3, one method for mechanically deaerating bitumen froth comprises passing the froth from the PSV through a low shear, low speed impeller. As previously mentioned, aerated bitumen froth floats to the top of the PSV 1 and attached to the PSV 1 is a froth launder 2 that catches the aerated bitumen froth as it spills over the top of the PSV 1.

Launder chute 3 is an extension of the launder 2 and is equipped with a weir box 4 through which the froth flows. The box 4 has a transverse wall 5 at its upstream end, forming a flow inlet 6. The floor 8 of the chute 3 forms the bottom wall 9 of the box 4. The bottom wall 9 forms an opening 10 communicating with a funnel 11 forming a confining passageway 12. Contained within the boundaries of the funnel 11 and positioned directly below the opening 10 is a low shear, low speed impeller 13 mounted on a shaft 14 driven by a motor 15. A second larger impeller 16 is located directly above the bottom opening 10. The second impeller 16 aids in directing the viscous bitumen froth through the bottom opening 10 and past the low shear impeller 13. Vertical baffles 17 are placed directly below the shearing impeller 13. The baffles 17 prevent the viscous bitumen froth from simply turning with the impeller 13. The weir 7 impedes the flow of the bitumen froth thereby forcing all of the froth to pass through the impeller 13. The box 4 has a downstream transverse wall 18 which functions as a weir to aid in retarding the flow of the bitumen froth to further ensure that all of the froth is subjected to the shearing process.

The deaerated bitumen froth exits the launder 2 via the launder chute 3 into a froth holding tank (not shown).

Figure 5:
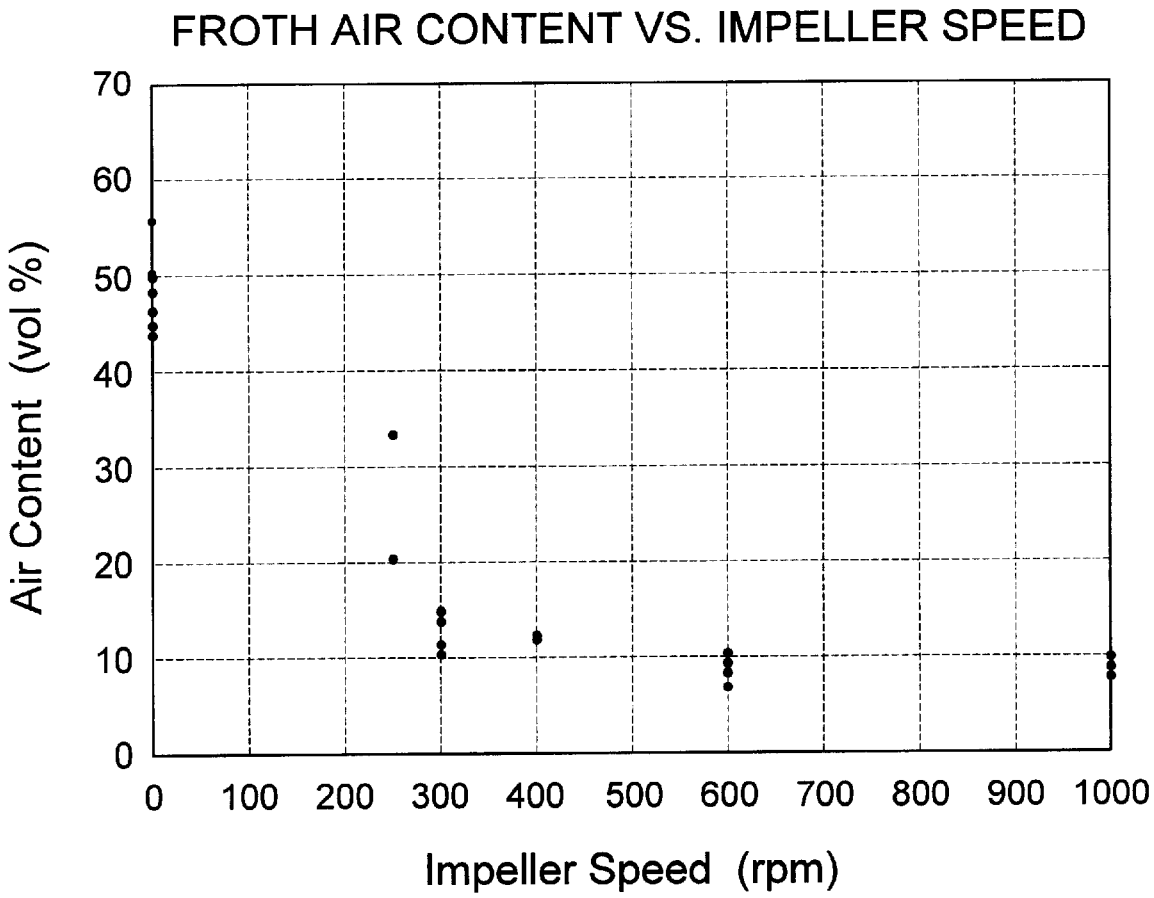
FIG. 5 is a plot of bitumen froth air content versus impeller speed, for two tests run using the PSV and deaerating device shown in FIGS. 2 and 3.

In FIG. 5, a circuit 20 is shown for practicing an alternative method for deaerating bitumen froth. This method comprises pumping the froth one or more times through a positive displacement pump. More particularly, aerated froth travels down the launder chute 3 and exits into a froth holding first tank 22. The froth is pumped out of the first tank 22 via a positive displacement discharge pump 23 through a conduit 24 and drops into a froth holding second tank 25. For the purposes of the experiment only, any water and solids that settle at the bottom of the second tank 25 are first pumped out of the tank via a positive displacement circulation pump 26 through conduit 27 and discarded. The remaining bitumen froth is then pumped out of the second tank 25 via the circulation pump 26 and recirculated through conduit 28 back to the second tank 25. The froth is recirculated through the circulation pump 26 until deaeration is complete.

The operability of these two methods is demonstrated by the following examples.

EXAMPLE I

In this example, bitumen froth was deaerated using the impeller process. Several different aerated bitumen froth preparations were recovered from the same low grade oil sand (7.9% bitumen, 39% −44$\mu$ fines ) using the LEE process. The bitumen froth tested consisted of, on average, 39 wt % bitumen, 49 wt % water and 13 wt % solids. The average air content of the froth was 50 vol. %. The froth temperature at the shearing impeller 13 was between 35 and 38° C. A larger 6 bladed pitched impeller 16, 101 mm in diameter and 29 mm high, was used to force the froth past a smaller 4 bladed turbine shearing impeller, 38 mm in diameter and 11 mm high.

Samples of the deaerated froth were collected as the froth exited the launder 2 via the launder chute 3. FIG. 4 shows the froth air content of the bitumen froth after having passed through the shearing impeller, the shearing impeller being operated over a range of speeds.

It can be seen from the results in FIG. 4 that reduction in air content of the bitumen froth leveled off as the impeller speed approached 600 rpm. At speeds over 600 rpm, the air content of the froth remained fairly constant at about 10 vol. %.

EXAMPLE II

The bitumen froth samples tested in the following example were recovered from four different oil sand batches using the LEE process. Samples 1 and 2 were recovered from low grade oil sands (7.3 wt % bitumen, 31.9 wt % fines and 8.0 wt % bitumen, 34.6 wt % fines, respectively) and samples 3 and 4 were recovered from medium grade oil sands (10.9 wt % bitumen, 23.5 wt % fines and 11.6 wt % bitumen, 18.9 wt % fines, respectively).

With reference to FIG. 5, aerated bitumen froth was initially collected in the froth holding first tank 22. The collected froth was then pumped to the froth holding second tank 25 through ¾ inch diameter pipe 24 by means of a Moyno 2L4 discharge pump 23 until the second tank was filled with bitumen froth. Because it took time to fill the tank (up to two hours), water and sand had settled out at the bottom of the tank. Therefore, when the tank was finally filled, pipe 27 was opened and the water and sand that had settled at the bottom of the tank were pumped out via a Moyno 1L3 circulation pump 26. Pipe 27 was then closed and pipe 28 was opened. The froth was then pumped out through pipe 28 via the circulation pump 26 and recirculated back to the second tank 25. After the first recirculation, the froth was continuously recirculated in this fashion for approximately 1 hour.

Table 1 shows the composition of the four froth samples in the second tank 25 after the settled sand and water had been removed from the tank.

TABLE 1

| | Bitumen wt % | Water wt % | Solids wt % | Froth temp. |
|---|---|---|---|---|
| Sample 1 | 60 | 27 | 13 | 38° C. |
| Sample 2 | 46 | 40 | 14 | 30° C. |
| Sample 3 | 60 | 29 | 11 | 35° C. |
| Sample 4 | 55 | 30 | 15 | 43° C. |

Table 2 shows the air content of each of the above samples at various stages of the above process. An initial sample was taken from the first tank 22 and is referred to as "static froth". A second sample was taken from the second tank 25 after the froth was pumped through the ¾ inch diameter pipe 24 via the Moyno 2L4 discharge pump 23. This froth sample is referred to as "once-through froth" as it has already been pumped through one pump. A third sample of froth was taken after the froth had been pumped through pipe 28 via the Moyno 1L3 circulation pump 26 and this froth sample is referred to as "recirculated froth".

TABLE 2

| | Static | Once-through | Recirculated |
|---|---|---|---|
| Sample 1 | 41 vol. % air | 21 vol. % air | 6 vol. % air |
| Sample 2 | 49 vol. % air | 19 vol. % air | 11 vol. % air |
| Sample 3 | 39 vol. % air | 33 vol. % air | 4 vol. % air |
| Sample 4 | 44 vol. % air | 30 vol. % air | 4 vol. % air |

Table 2 shows that a single pass through a progressive cavity pump (i.e. the discharge pump 23) reduced the air content of the low grade oil sand froth samples (1 and 2) from 45 vol. % to 20 vol. % on average. The air content of the medium grade oil sand froth samples (3 and 4) was also reduced after a single pass from 41.5 vol. % to 31.5 vol. % on average. However, the reduction was less dramatic with the medium grade samples than with the low grade samples suggesting that pumping is a less effective means for liberating air when medium grade oil sand is used.

Figure 6:
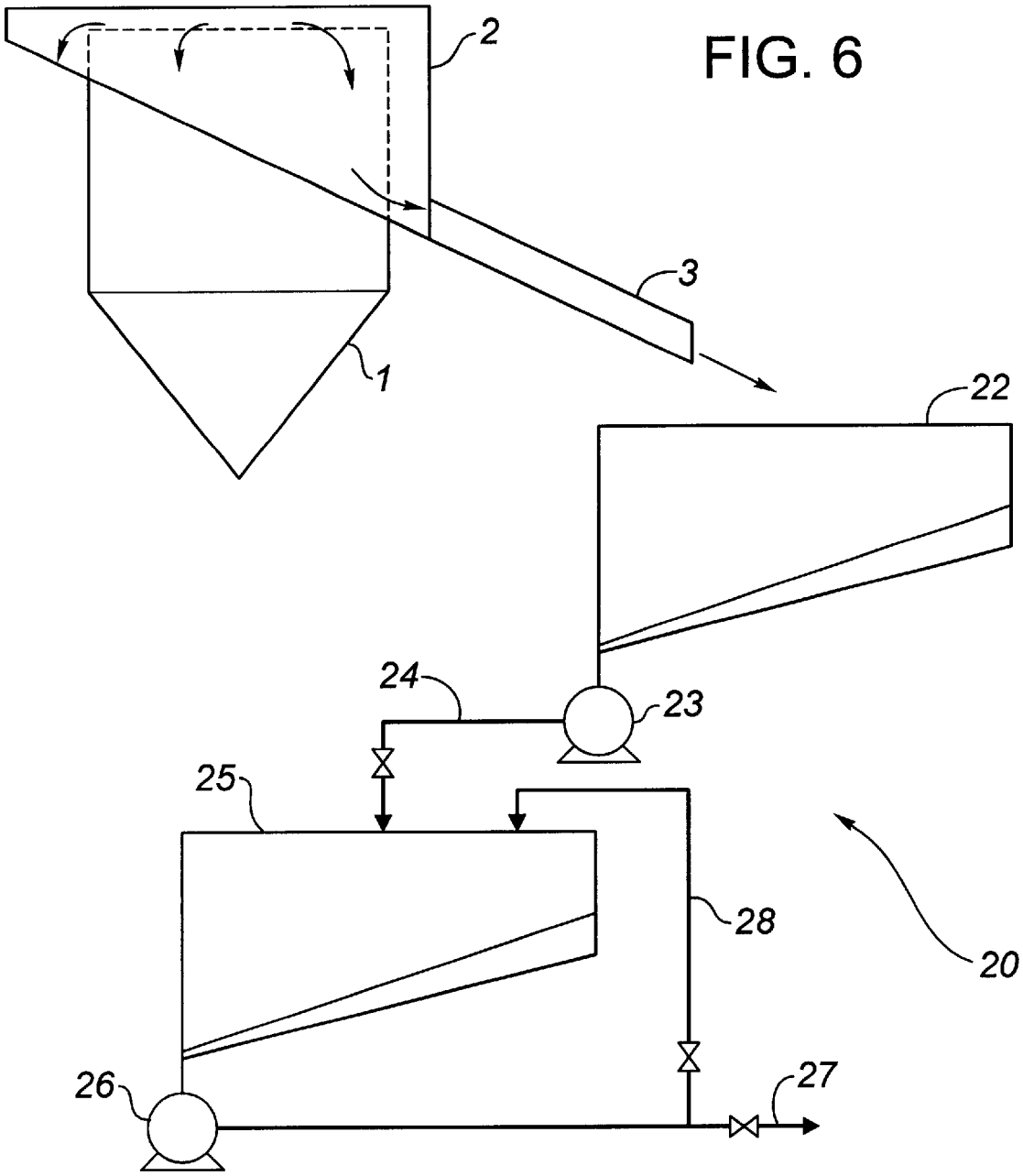
FIG. 6 is a schematic showing a test circuit used in the mechanical deaeration process of repeated pumping.
Figure 7:
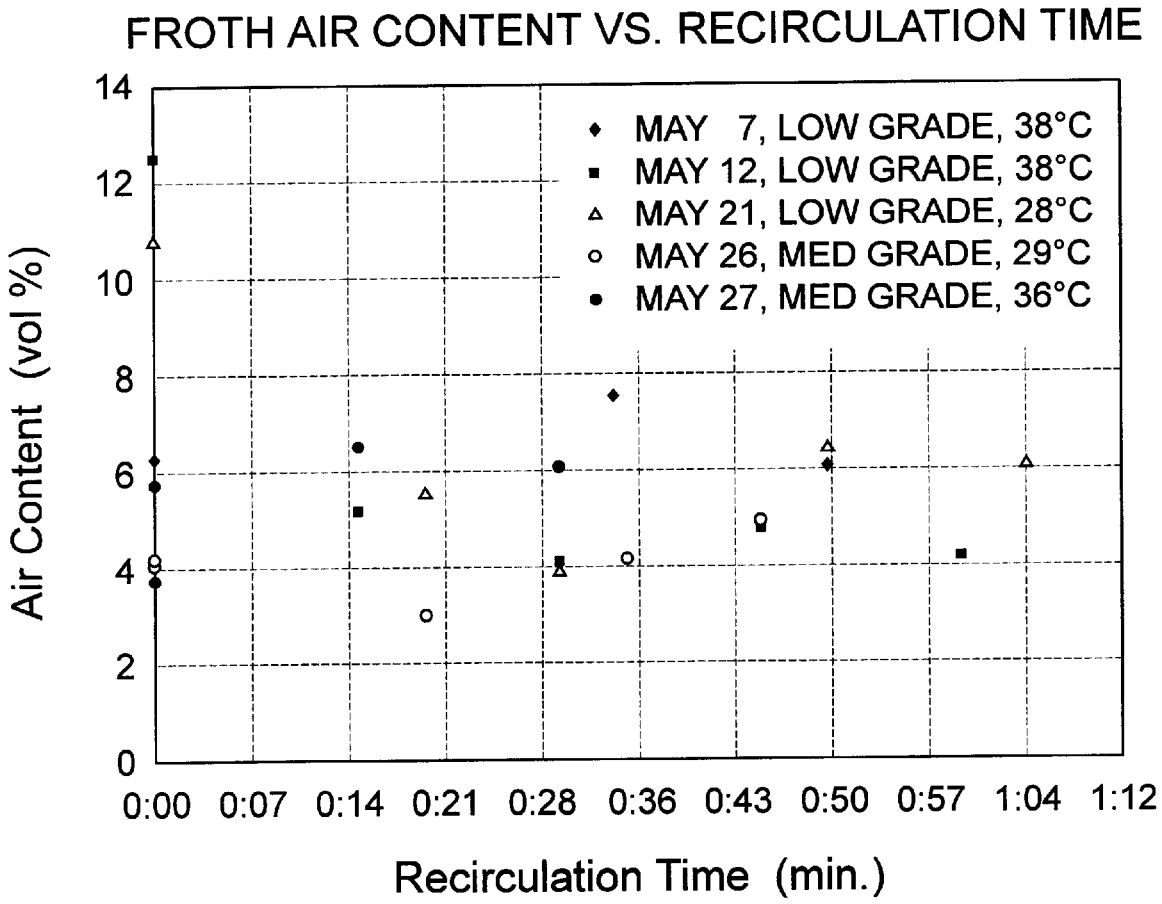
FIG. 7 is a plot of the bitumen froth air content versus recirculation time using repeated pumping.

However, after the second pass through a gravity pump (i.e. the circulation pump 26 ), froth samples 3 and 4 had air contents lower than the 6% target while froth samples 2 still contained 11 vol. % air. All froth samples were recirculated through the circulation pump 26 at a flow rate of 4 L/min for at least 60 minutes. Samples were taken every fifteen minutes and the air content determined. Note that the sample taken at time zero was after the froth had been pumped twice (once by each pump). Pumping the froth twice achieved the 6% target in several of the cases. FIG. 6 shows that the air content of all four s rapidly reached steady levels of 4 to 6 vol. % air.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited are hereby incorporated by reference.

From the foregoing description, one skilled in the art can easily ascertain the essential characteristics of this invention, and without departing from the spirit and scope thereof, can make various changes an modifications of the invention to adapt it to various usages and conditions.

The embodiments of the invention in which and exclusive property or privilege is claimed are defined as follows:

1. A method for deaerating aerated bitumen froth produced by flotation in a primary separation vessel and recovered therefrom, comprising:

mechanically shearing the aerated froth to reduce its air content sufficiently so that the deaerated froth can be pumped through a pipeline, wherein the mechanical shearing is conducted by:

a) passing the aerated froth through a confining passageway and mechanically shearing it with an impeller while in the passageway, or b) mechanically shearing the aerated froth by repeated circulation through a pump, or c) a combination of a) and b).

2. The method as set forth in claim 1 wherein the air content of the froth is reduced to less than 10 volume percent.

3. The method as set forth in claim 1 wherein the air content of the froth is reduced to less than 6 volume percent.

4. A method for recovering deaerated bitumen froth from oil sand containing bitumen, comprising:

dry mining the oil sand;

mixing the as-mined oil sand with heated water to produce a slurry having a density in the range 1.4 to 1.65 g/cc and temperature in the range 20–35° C.;

pumping the slurry through a pipeline for sufficient distance to condition the slurry;

adding air to the slurry as it moves through the pipeline, to produce aerated slurry;

introducing the aerated slurry into a primary separation vessel and temporarily retaining it therein under quiescent conditions to produce aerated bitumen froth;

recovering the aerated froth and mechanically shearing it to deaerate it sufficiently so that the deaerated froth can be pumped through a pipeline, wherein the mechanical shearing is conducted by:

a) passing the aerated froth through a confining passageway and mechanically shearing it with an impeller while in the passageway, or b) mechanically shearing the aerated froth by repeated circulation through a pump, or c) a combination of a) and b).

5. The method set forth in claim 4 comprising:

adjusting the density of the slurry as it approaches the primary separation vessel to reduce its density to less than 1.5 g/cc;

venting excess air from the primary separation vessel through a vent stack extending into the aerated slurry in the vessel; and adding sufficient heated water as an underwash layer just beneath the froth to ensure production of froth having a temperature greater than about 35° C.

6. The method as set forth in claim 5 wherein:

the recovered bitumen froth is passed through a confining passageway and mechanically sheared with an impeller while in the passageway.

7. The method as set forth in claim 5 wherein:

the recovered bitumen froth is mechanically sheared by repeated circulation through a pump.

8. The method as set forth in claim 4 wherein the air content of the froth is reduced to less than 10 volume percent.

9. The method as set forth in claim 4 or wherein the air content of the froth is reduced to less than 6 volume percent.

10. A method according to claim 1, wherein the mechanical shearing is conducted upstream of a pipeline, and further comprising pumping the resultant deaerated froth through said pipeline.

11. A method for deaerating aerated bitumen froth produced by flotation in a primary separation vessel and recovered therefrom, comprising:

mechanically shearing the aerated froth at a temperature of 20 to 45° C. to reduce its air content sufficiently so that the deaerated froth can be pumped through a pipeline.

12. The method of claim 11, wherein the mechanical shearing is conducted by:

a) passing the aerated froth through a confining passageway and mechanically shearing it with an impeller while in the passageway, or b) mechanically shearing the aerated froth by repeated circulation through a pump, or c) a combination of a) and b).

* * * * *